United States Patent [19]

Lie

[11] Patent Number: 4,509,743

[45] Date of Patent: Apr. 9, 1985

[54] BALANCE TRAINING APPARATUS

[75] Inventor: Hakon Lie, Oslo, Norway

[73] Assignee: Chatanooga Corporation, Chattanooga, Tenn.

[21] Appl. No.: 472,678

[22] Filed: Mar. 7, 1983

[30] Foreign Application Priority Data

Mar. 10, 1982 [NO] Norway ..... 820780

[51] Int. Cl.[3] ..... A63B 23/04; A63B 69/18

[52] U.S. Cl. ..... 272/97; 272/146

[58] Field of Search ..... 272/97, 146, 65, 143, 272/144, 93; 128/25 R, 25 B; 434/253

[56] References Cited

U.S. PATENT DOCUMENTS

| | | | |
|---|---|---|---|
| 2,573,808 | 11/1951 | Ravoire | 272/97 |
| 2,785,896 | 3/1957 | Ellis | 272/146 |
| 3,364,875 | 1/1968 | Balaisis | 272/97 |
| 3,374,782 | 3/1968 | Izzo | 272/97 |
| 3,461,857 | 8/1969 | Poulin | 272/97 |
| 3,612,520 | 10/1971 | Chang . | |
| 3,730,521 | 5/1973 | Sellman | 272/146 |
| 4,290,601 | 9/1981 | Mittelstadt . | |

FOREIGN PATENT DOCUMENTS

| | | | |
|---|---|---|---|
| 701992 | 1/1941 | Fed. Rep. of Germany . | |
| 2713382 | 3/1977 | Fed. Rep. of Germany . | |
| 2266011 | 7/1977 | Fed. Rep. of Germany | 272/97 |
| 1360732 | 4/1964 | France | 253/ |
| 2364044 | 4/1978 | France . | |
| 902675 | 8/1960 | United Kingdom | 272/97 |

*Primary Examiner*—Richard J. Apley
*Assistant Examiner*—S. R. Crow
*Attorney, Agent, or Firm*—Bell, Seltzer, Park & Gibson

[57] ABSTRACT

An apparatus for the balance training of athletes, such as downhill skiers, is disclosed, and which comprises a base adapted to rest upon the floor, and a foot plate mounted in spaced relation above the base. The foot plate and base are interconnected by a plurality of springs disposed in a circular arrangement around the center of the foot plate so as to permit tilting of the foot plate relative to the base in all directions. Drive means is also provided for imparting a continuous irregular tilting movement to the foot plate, and which includes an electric motor, a vertical centerpost connected to the output of the motor, an undulating cam plate fixed to the underside of the foot plate, and a follower fixed to the centerpost. Thus upon operation of the motor, the centerpost is rotated and a continuous irregular tilting movement is imparted to the foot plate.

10 Claims, 9 Drawing Figures

BALANCE TRAINING APPARATUS

The present invention relates to an apparatus for the balance training of athletes, and which is particularly adapted for use in the training of downhill skiers. In such instance, the apparatus permits training for balance and coordination, at various levels of difficulty, by providing for the support upon which the athlete stands to continuously change its inclination or slope in an irregular manner. The level of difficulty may be changed by adjusting the speed of operation, and/or the magnitude of the irregular tilting movements.

Balance and coordination are important skills in mastering downhill skiing, and together with technique, muscular strength, condition, and quickness, they determine the overall ability and skill of the skier. Training to achieve balance and coordination is difficult without actually skiing. While balance plates and rolling boards have heretofore been proposed for such training, these prior devices have the disadvantage that the skier himself manipulates the positioning of the plate or board. In actual skiing, it happens in the opposite way, i.e., when moving downhill it is the ground which irregularly moves against the skier, and the skier must adjust to such irregular movement with coordinated movement of the arms, legs, body, and weight. A limiting factor in the skill of a downhill skier is the ability of the skier to quickly meet the irregularities of the ground surface in a well coordinated and controlled manner.

The proprioceptive sense, which refers to the ability to feel the position of a joint, may be improved by imparting movements to the joints, ligaments, and tendons. By changing the position of the ground, the ankle, knee, and hip joint will all change their position. The ability of a person to rapidly change the position of different parts of the body in order to accommodate the changes in the inclination of the ground may be improved by proprioceptive training. With an increasing speed in the changes in the orientation of the ground, as well as the magnitude of the changes, the proprioceptive sense, and thus also the balance and coordination, may be markedly improved.

It is accordingly an object of the present invention to provide a training apparatus for downhill skiers and other athletes, which is adpated to improve balance and coordination.

It is also an object of the present invention to provide a balance training apparatus useful in physical medicine and rehabilitation, in the treatment of neurological diseases with balance problems, and in the rehabilitation of patients with ankle, knee, and hip injuries.

These and other objects and advantages of the present invention are achieved in the embodiment illustrated herein by the provision of a balance training apparatus which comprises a base adapted to rest upon a horizontal supporting surface such as the ground, and a foot plate upon which an athlete is adapted to stand, with the foot plate being supported in spaced relation above the base. The means for supporting the foot plate includes resilient means interconnecting the base and foot plate along at least a plurality of locations disposed in a generally circular arrangement around the central portion of the foot plate. The apparatus also includes drive means for imparting continuous irregular tilting movement to the foot plate relative to the base, whereby an athlete standing upon the foot plate is required to continuously adjust to the continuously changing inclination of the foot plate.

In the preferred embodiment, the drive means includes an electric motor, and means whereby the athlete may change the speed of the motor and thus the speed of the continuously changing tilting movements. Means are also provided whereby the magnitude of the tilting movements may be readily changed.

Some of the objects and advantages of the invention having been stated, others will appear as the description proceeds, when taken in connection with the accompanying drawings, in which.

Figure 1:
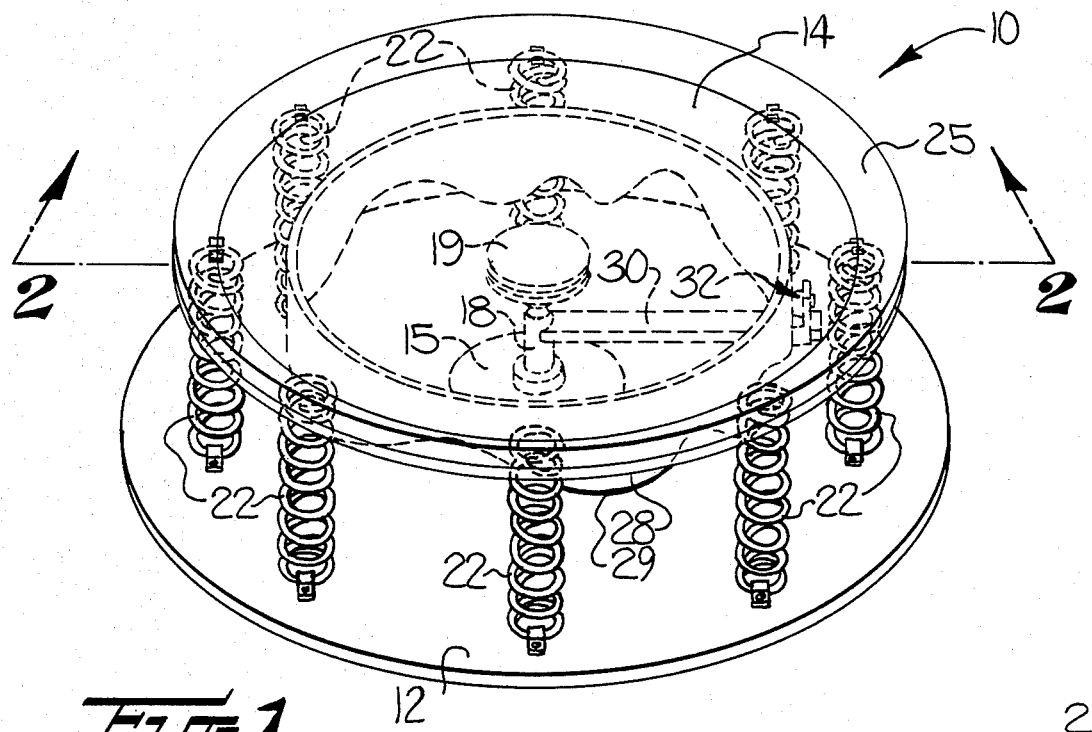
FIG. 1 is a perspective view of a balance training apparatus in accordance with the preferred embodiment of the invention.

Referring more particularly to the drawings, there is illustrated a preferred embodiment of a balance training apparatus at 10. The apparatus includes a base 12 in the form of a circular plate having a diameter of about one-half meter, and which is adapted to rest upon a horizontal supporting surface such as the floor of a room or the ground. A circular foot plate 14 is interconnected to the base, with the foot plate being disposed in spaced relation above the base in the manner best seen in FIG. 2.

A variable speed electric motor 15 is mounted centrally on the base 12, and the motor is controllable by a switch 16 which is accessible to the athlete standing upon the foot plate 14. The motor is oriented so that its output shaft extends vertically upward from the base to define a vertical centerpost 18 having an axis which perpendicularly intersects the center of the foot plate. The upper end of the centerpost is joined to the foot plate by means of a bearing 19 which permits the centerpost to rotate with respect to the foot plate. In addition, there is provided a ball and socket joint 20 between the centerpost and the foot plate for permitting the foot plate to tilt in any orientation with respect to the base.

Figure 2A:
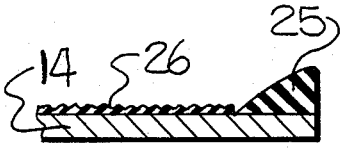
FIG. 2A is a fragmentary sectional view illustrating the use of a rubber mat or other high friction material placed on the upper surface of the foot plate.
Figure 2:
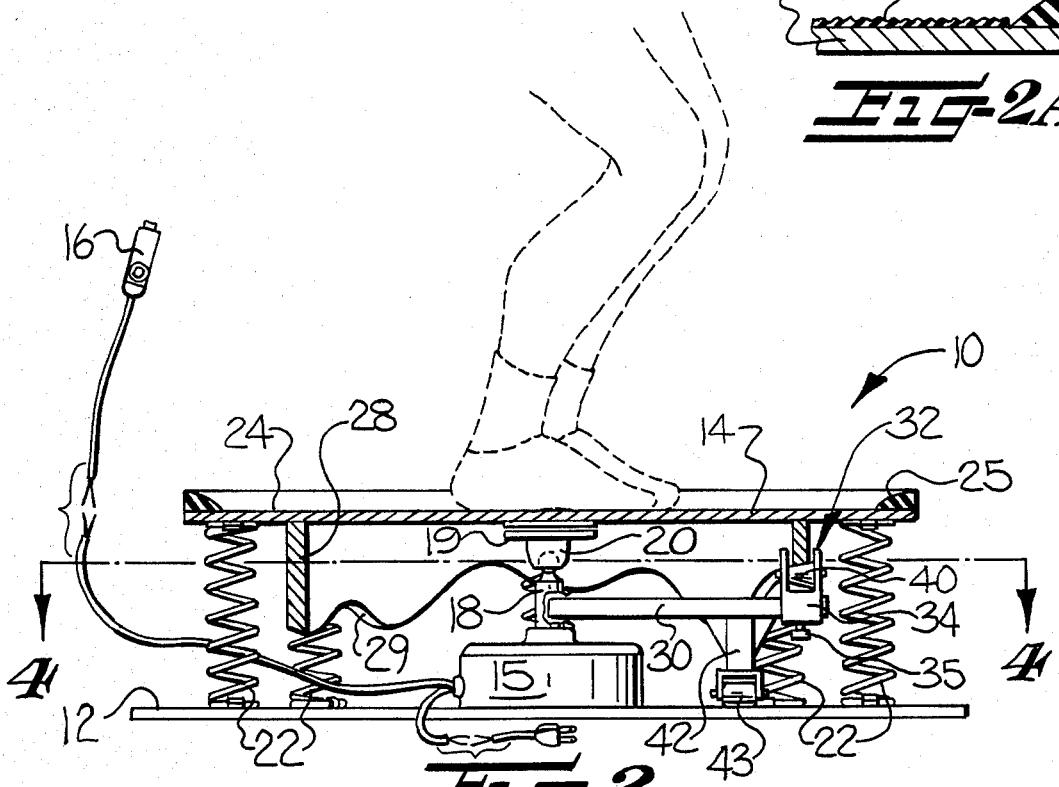
FIG. 2 is a sectional side elevation view taken substantially along the line 2—2 of FIG. 1.
Figure 3:
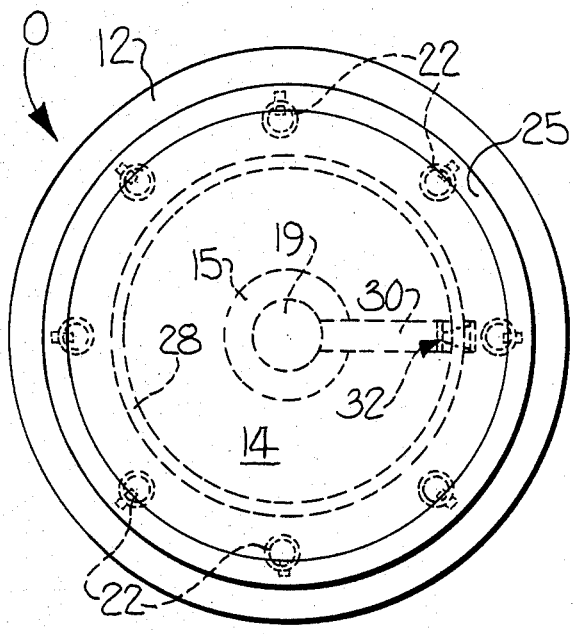
FIG. 3 is a top plan view of the apparatus shown in FIG. 1.
Figure 4:
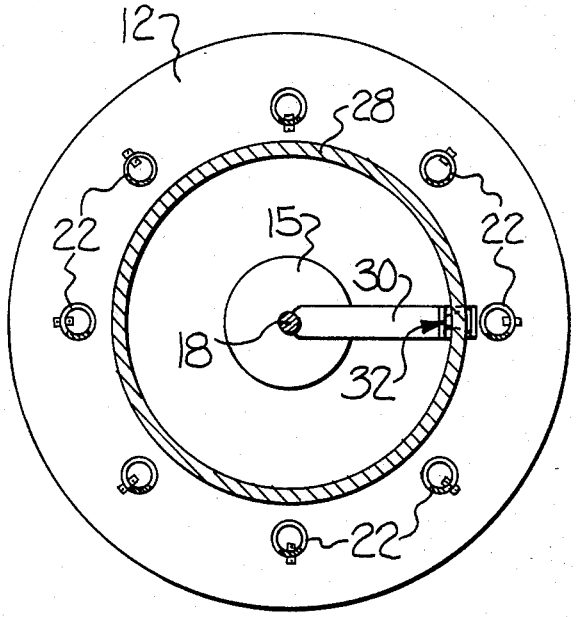
FIG. 4 is a sectional view taken substantially along the line 4—4 of FIG. 2.

The means supporting the foot plate 14 above the base 12 includes a plurality of coil springs 22 disposed in an equally spaced apart, circular arrangement adjacent the periphery of the base and foot plate, and with the centerpost 18 being disposed at the center of the circle defined by the springs. The upper surface 24 of the foot plate 14 may be smooth and relatively slippery as indicated in FIG. 2, with a raised circular border 25 of a rubber-like material disposed about its periphery. Alternatively, the upper surface of the foot plate may include a non-slippery rubber pad 26 or the like, note FIG. 2A.

Figure 5:
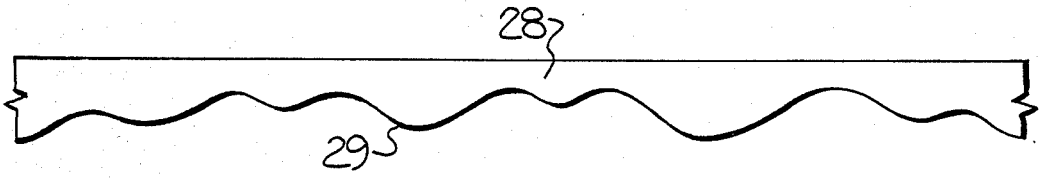
FIG. 5 is a view of the circular cam plate of the apparatus projected onto a flat surface.
Figure 6:
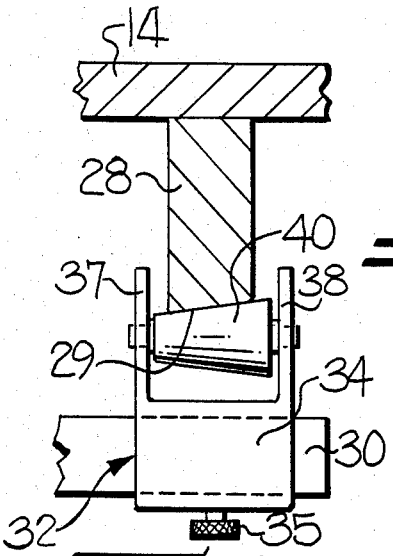
FIG. 6 is a fragmentary sectional view of the cam plate and follower.
Figure 7:
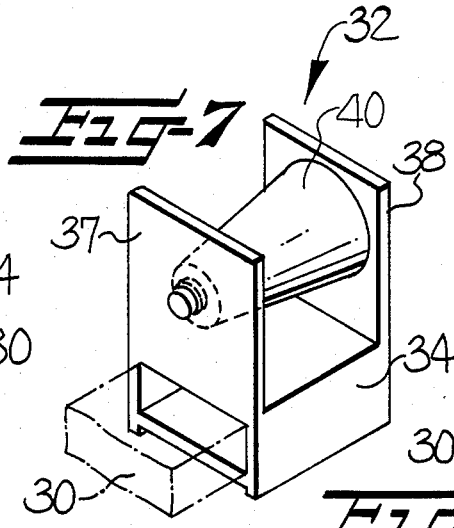
FIG. 7 is a perspective view of the follower shown in FIG. 6.
Figure 8:
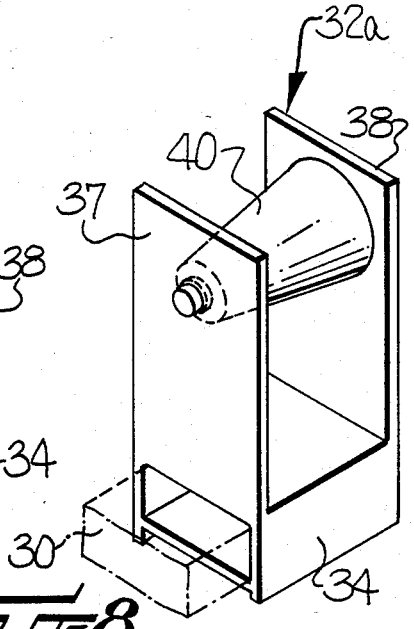
FIG. 8 is a perspective view similar to FIG. 7 and showing an alternative embodiment which provides for an increase in the magnitude of the tilting movements.

In order to impart the desired continuous irregular tilting movement of the foot plate relative to the base, there is provided a circular depending cam plate 28 fixed to the underside of the foot plate. The lower edge of the cam plate defines a cam surface 29 which undulates in an irregular manner as best seen in FIG. 5. A lever arm 30 is fixed to the centerpost 18 and extends outwardly in a radial direction, and a cam follower 32 is mounted adjacent the end of the lever arm 30. The cam follower 32 includes a bracket 34 releasably mounted on the lever arm by a set screw 35 or the like, and the bracket includes a pair of arms 37, 38 disposed on respective opposite sides of the cam plate 28. Also, a conical roller 40 is mounted between the arms as best seen in FIGS. 6 and 7, and the cam surface 29 is inclined so as to conform to the tapered surface of the roller 40. The cam follower 32 is removably mounted adjacent the end of the lever arm by releasing the set screw 35 to permit an alternative cam follower 32*a* of greater height to be substituted for the cam follower 32. As will be apparent, the use of the cam follower 32*a* will cause the magnitude of the tilting movement of the foot plate 14 to be increased.

To provide reinforcement for the lever arm 30, there may be provided a depending support 42 which is mounted to the lever arm generally beneath the cam follower 32. The support 42 includes a roller 43 at the lower end, which is designed to roll upon the surface of the base 12, to transmit the vertical forces exerted on the follower 32 directly to the base 12.

In operation, the athlete stands upon the foot plate 14 as illustrated in FIG. 2, and actuates the switch 16 to commence operation of the motor 15. This causes the centerpost 18 to rotate relative to the foot plate 14, and the cam follower 32 to move along the cam surface 29, causing the foot plate 14 to tilt in a continuous, irregular manner. The peripheral springs 22 act to stabilize the tilting movement, and maintain contact between the cam surface 29 and roller 40 of the follower 32.

If desired, the switch 16 may incorporate a speed control, by which the rotational speed of the motor may be selectively increased or decreased. Further, it will be apparent that substitution of the taller cam follower 32*a* will increase the magnitude of the tilting movements. In the event the upper surface 24 of the foot plate 14 is smooth, and the athlete is wearing socks, the feet will tend to slide on the surface during the tilting movement, thereby rendering it more difficult for the athlete to maintain balance. If a rubber pad 26 is placed on the surface 24, such sliding movement would not normally occur, and balancing would be somewhat less difficult.

In the drawings and specification, there has been set forth a preferred embodiment of the invention, and although specific terms are employed, they are used in a generic and descriptive sense only and not for purposes of limitation.

That which is claimed is:

1. An apparatus for the balance training of athletes, and which is particularly adapted for use in training for downhill skiing, and comprising a base adapted to rest upon a horizontal supporting surface, a foot plate upon which the athlete is adapted to stand, means supporting said foot plate in spaced relation above said base, said supporting means including resilient means joining said base and foot plate and disposed in a generally circular arrangement around the central portion of the foot plate, and drive means for imparting continuous irregular tilting movement of said foot plate relative to said base, whereby an athlete standing upon said foot plate is required to continuously adjust to the changing inclination of the foot plate, said drive means including a circular cam plate defining an irregularly undulating cam surface which is disposed between said base and said foot plate and coaxially about said central portion of said foot plate, with said cam plate being fixed to one of either said base or said foot plate, and cam follower means disposed between said cam surface and the other of said base or said foot plate, and means for drivingly moving said cam follower means in a circular path of travel along said cam surface.

2. The apparatus as defined in claim 1 wherein said means for drivingly moving said cam follower means includes an electric motor mounted to said base, and an upwardly directed centerpost defining an axis which perpendicularly intersects the foot plate at said central portion thereof, and with said centerpost being operatively interconnected to the output of said electric motor so that the motor is adapted to rotate the centerpost about its axis, and a lever arm extending radially from said centerpost and connected to said cam follower means.

3. The apparatus as defined in claim 2 wherein said resilient means comprises a plurality of springs arranged around the axis of said centerpost.

4. An apparatus for the balance training of athletes, and which is particularly adapted for use in training for downhill skiing, and comprising a base adapted to rest upon a horizontal supporting surface, a circular foot plate upon which the athlete is adapted to stand, means supporting said foot plate in spaced relation above said base, said supporting means including resilient means joining said base and foot plate along at least a plurality of locations disposed in a generally circular arrangement around the center of the foot plate, and drive means for imparting continuous irregular tilting movement of said foot plate relative to said base, said drive means including an electric motor mounted to said base, an upwardly directed centerpost defining an axis which perpendicularly intersects the center of said foot plate, means operatively interconnecting the output of said electric motor to said centerpost, means interconnecting the upper end of said centerpost to said foot plate so as to permit rotation of said centerpost relative to said foot plate and tilting movement of said foot plate relative to said base, a circular cam plate defining an irregularly undulating cam surface which is disposed between said base and said foot plate and coaxially about said center of said foot plate, with said cam plate being fixed to one of either said base or said foot plate, and cam follower means disposed between said cam surface and the other of said base and said foot plate, and means operatively interconnecting said centerpost to said cam follower means such that operation of said motor causes the centerpost to rotate and the cam follower means to move along a circular path of travel along said cam surface, and whereby an athlete standing upon said foot plate is required to continuously adjust to the changing inclination of the foot plate.

5. The apparatus as defined in claim 4 wherein said resilient means joining said base and foot plate comprises a plurality of helical springs disposed in an equally spaced apart, circular arrangement about the axis of said centerpost and adjacent the periphery of said foot plate.

6. The apparatus as defined in claim 5 further including speed control means for selectively changing the speed of the motor, to thereby change the speed of the tilting movement of the foot plate.

7. The apparatus as defined in claim 6 wherein said means operatively interconnecting said centerpost to said cam follower means comprises a lever arm extending radially between said centerpost and said cam follower means, and said cam follower means includes a bracket mounted to said lever arm, said bracket having a pair of spaced apart arms disposed on respective opposite sides of said cam plate, and a roller mounted between said pair of arms and engaging said cam surface.

8. The apparatus as defined in claim 7 further comprising means releasably connecting said bracket to said lever arm, whereby brackets of different heights may be selectively mounted on said lever arm to permit adjustment of the magnitude of the tilting movement.

9. The apparatus as defined in claim 4 wherein the upper surface of said foot plate is relatively smooth and slippery, and includes a raised circular border.

10. The apparatus as defined in claim 4 wherein the upper surface of said foot plate includes a relatively non-slippery rubber-like mat, and a raised circular border.

* * * * *